US007386893B2

(12) United States Patent
Chang

(10) Patent No.: US 7,386,893 B2
(45) Date of Patent: Jun. 17, 2008

(54) LAMINATED SEWING-FREE CONCEALED ZIPPER CLOSURE FOR AN OUTWEAR HAVING ONE-PIECE-FABRIC-SLIT BODY AND METHOD OF MAKING SAME

(75) Inventor: Yung-Sheng Chang, Taipei (TW)

(73) Assignee: J. Adams & Associates Limited, Taipei (TW)

( * ) Notice: Subject to any disclaimer, the term of this patent is extended or adjusted under 35 U.S.C. 154(b) by 496 days.

(21) Appl. No.: 11/044,647

(22) Filed: Jan. 27, 2005

(65) Prior Publication Data

US 2006/0162042 A1 Jul. 27, 2006

(51) Int. Cl.
*A41D 3/02* (2006.01)
*A44B 19/34* (2006.01)

(52) U.S. Cl. ..... 2/96; 2/87; 24/432

(58) Field of Classification Search ..... 2/2.17, 2/87, 96, 97, 100, 265, 234; 24/432, 389
See application file for complete search history.

(56) References Cited

U.S. PATENT DOCUMENTS 2,148,269 A * 2/1939 Koch ..... 2/74
3,335,425 A * 8/1967 Senser ..... 2/96
3,449,764 A * 6/1969 De Fazio et al. ..... 2/96
3,561,073 A * 2/1971 Rosser ..... 24/432
3,883,381 A * 5/1975 Thaeler ..... 156/66
5,042,117 A * 8/1991 Tsubata ..... 24/381
5,386,616 A * 2/1995 Norvell ..... 24/389
5,444,898 A * 8/1995 Norvell ..... 24/389
6,237,152 B1 * 5/2001 Gootrad ..... 2/87
6,571,432 B1 * 6/2003 Rindle ..... 24/432
6,651,254 B1 * 11/2003 Chang ..... 2/87
6,668,384 B1 * 12/2003 Chang ..... 2/96
6,675,390 B1 * 1/2004 Chang ..... 2/96
6,691,326 B2 * 2/2004 Hexels ..... 2/457
7,191,497 B2 * 3/2007 Butz ..... 24/389
7,200,900 B2 * 4/2007 Berns ..... 24/432
2004/0139528 A1 * 7/2004 Hord ..... 2/96
2004/0237266 A1 * 12/2004 Wang ..... 24/389
2005/0183247 A1 * 8/2005 Berns ..... 24/432

* cited by examiner

*Primary Examiner*—Alissa L Hoey
(74) *Attorney, Agent, or Firm*—Ladas and Parry LLP

(57) ABSTRACT

Disclosed is an improved laminated concealed zipper closure for an outwear, comprising: an upper fabric formed with one slit dividing the upper fabric into a left panel and a right panel, each of the left and right panels having an edge facing the other; a first narrow fabric piece attached underneath the left panel; a second narrow fabric piece attached underneath the right panel; a zipper attached underneath the first narrow fabric piece and the second narrow fabric piece; a first transparent reinforcing member straddling over the edge of the left panel and the first narrow fabric piece; and a second transparent reinforcing member straddling over the edge of the right panel and the second narrow fabric piece. Further disclosed is a method of making such a laminated concealed zipper closure.

5 Claims, 3 Drawing Sheets

LAMINATED SEWING-FREE CONCEALED ZIPPER CLOSURE FOR AN OUTWEAR HAVING ONE-PIECE-FABRIC-SLIT BODY AND METHOD OF MAKING SAME

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Technical Field

The invention relates to an improved laminated zipper, particularly to an improved laminated sewing-free concealed zipper closure for an outwear having one-piece-fabric-slit body and method of making same.

2. Description of the Related Art

FIG. 1 shows a schematic drawing of a printed outwear having a conventional zipper closure. For a traditional printed fabric for a jacket or a coat, if an open front or side pockets with zippers is required, the jacket's or the coat's front panel is always integrated with different part of the fabric or stitching which results in different segments.

In addition, for a conventional zipper closure, the zipper is stitched directly to the front panel of the printed fabric, where the sewing thread also becomes another slit on the front panel. It's likely the whole printed jacket or coat will become a chaotic scrap front panel sewn together.

To overcome the drawbacks of such a design, it is necessary to provide a one-piece-fabric-slit body front with sewing-free laminated concealed zipper closure to make a consistent look of an outwear without any significant segment when it is made of a printed fabric.

SUMMARY OF THE INVENTION

To overcome the drawbacks of the prior art, it is thus an object of the present invention to provide a one-piece-fabric-slit body front with sewing-free laminated concealed zipper closure to make a consistent look of an outwear without any significant segment when it is made of printed fabric.

It is another object of the present invention to provide an laminated concealed zipper closure with extra strength against abrasion, a water-resistant effect and different clothing aesthetic.

It is another objective of the present invention to provide a method for making such a laminated concealed zipper closure.

To achieve these objects, an laminated concealed zipper closure in accordance with the present invention comprises: an upper fabric formed with one slit dividing the upper fabric into a left panel and a right panel, each of the left and right panels having an edge facing the other; a first narrow fabric piece attached underneath the left panel; a second narrow fabric piece attached underneath the right panel; a zipper attached underneath the first narrow fabric piece and the second narrow fabric piece; a first transparent reinforcing member straddling over the edge of the left panel and the first narrow fabric piece; and a second transparent reinforcing member straddling over the edge of the right panel and the second narrow fabric piece.

Accordingly, the present invention further discloses a method of making a laminated concealed zipper closure, comprising the steps of: (a) providing an upper fabric; (b) cutting a slit through the upper fabric and dividing the upper fabric into a left panel and a right panel each having an edge facing the other; (c) placing two narrow fabric pieces adjacent to each of the edges with a small gap between the respective edge; (d) placing a transparent reinforcing member above each of the edges and the respective narrow fabric pieces; (e) bending the transparent reinforcing member such that the transparent reinforcing member straddles over the edge of each of the left and right panels along the length thereof and substantially parallel to the slit and each of the narrow fabric pieces is underneath the upper fabric; (f) placing a thermally meltable compound between each of the left and right panels and the respective narrow fabric piece along the length of the slit; (g) stitching a first zipper tape underneath one of the two narrow fabric pieces; (h) stitching a second zipper tape underneath the other of the two narrow fabric pieces; and (i) heat-pressing the upper fabric, the two narrow fabric pieces and the first and the second zipper tapes.

These and other modifications and advantages will become even more apparent from the following detained description of a preferred embodiment of the invention and from the drawings in which:

DETAILED DESCRIPTION OF THE INVENTION

Figure 1:
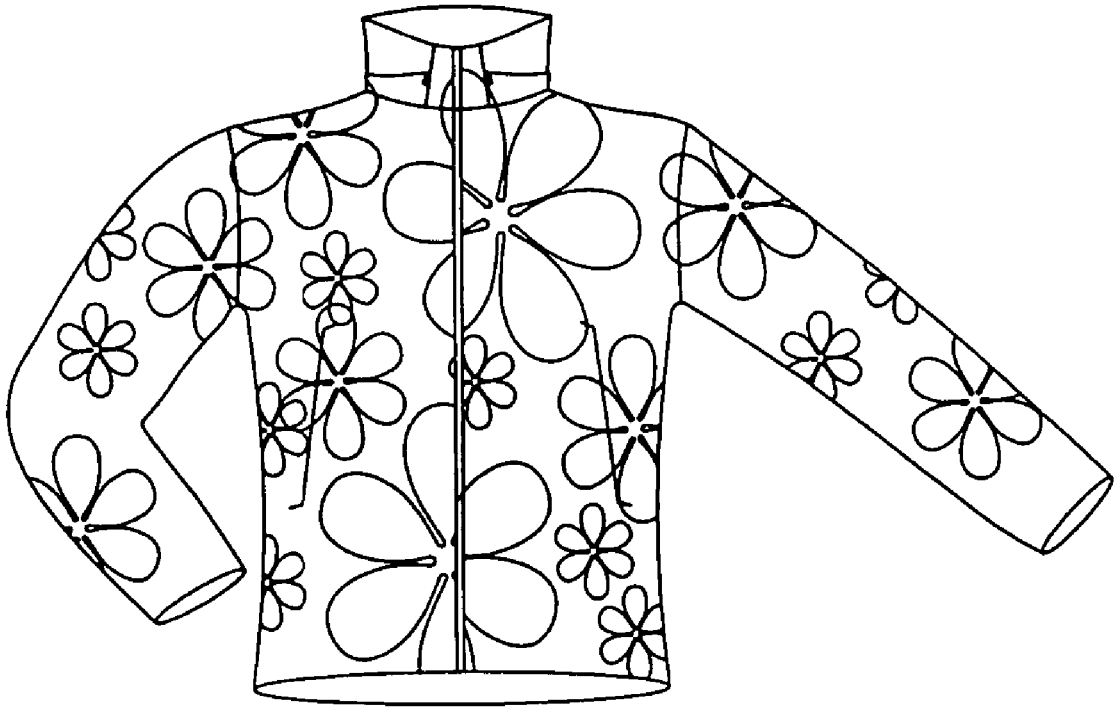
FIG. 1 (PRIOR ART)
FIG. 1 is a schematic drawing of a printed outwear having a conventional zipper closure.
Figure 2:
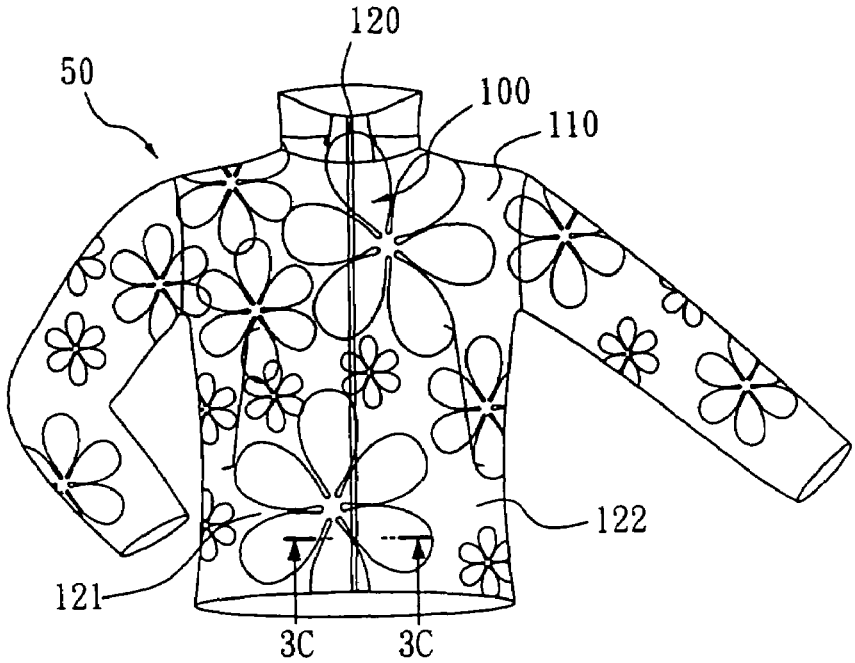
FIG. 2 is a schematic drawing of a printed outwear having a laminated sewing-free concealed zipper closure according to the present invention.

Referring FIG. 2, an improved laminated sewing-free concealed zipper closure 100 in accordance with the present invention is formed on a garment 50 of a printed fabric. The improved laminated zipper closure 100 includes an upper fabric 110, which is a part of an outer-shell of the garment 50 or another piece of fabric to be sewn to the outer-shell of the garment 50. The upper fabric 110 may be made of impregnated fabric (such as PU, PTFE, PVC, or rubber coated/laminated fabrics) or knit synthetic fabric (such as nylon, polyester, TC, CN). However, it should be noted that while applying the present invention to other types of garments, the fabric of the garment's shell can also be non-impregnated, especially highly breathable fabrics, which makes the garment fashionable with a neat outer appearance. Accordingly, the present invention may also be applied to a wide variety of fashions, but not limited to outdoor clothing.

Figure 3C:
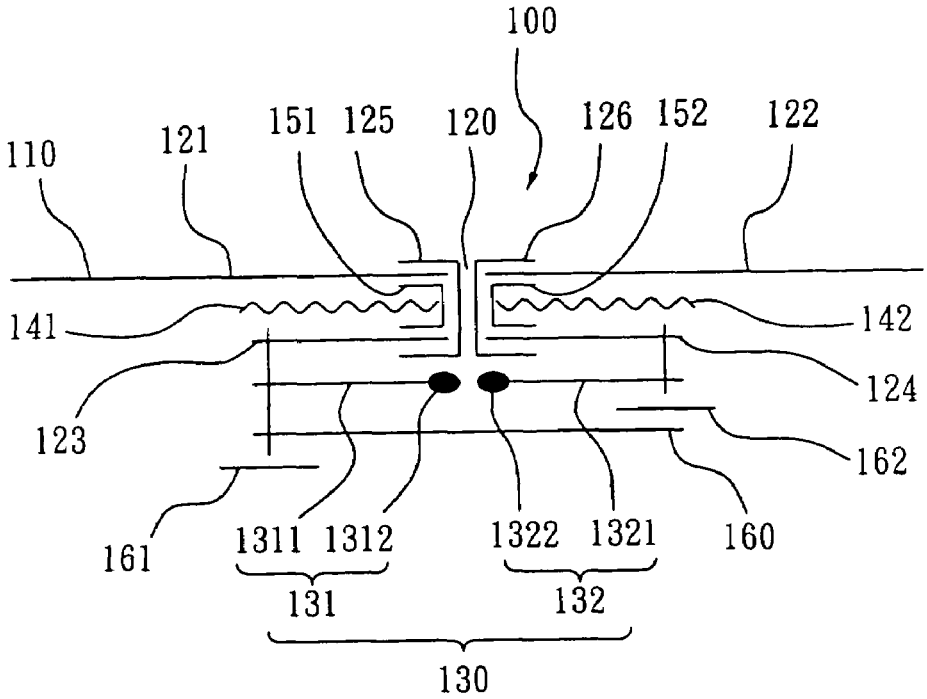
FIG. 3C is a cross-sectional view taken along lines 3C-3C of FIG. 2.

As illustrated in FIG. 3C, the upper fabric 110 is formed with a slit 120, preferably by a laser machine, stretched longitudinally and dividing the upper fabric 110 into a left panel 121 and a right panel 122. Each of the left and right panels has an edge facing the other. A first narrow fabric piece 123 of about 1.5 cm wide is attached underneath the left panel 121 along the length thereof while a second narrow fabric piece 124 of about 1.5 cm wide is attached underneath the right panel 122 along the length thereof.

A zipper 130, preferably nylon or plastic with a about 3 cm width, is attached underneath the first narrow fabric piece 123 and the second narrow fabric piece 124, and includes a first zipper tape 131, a second zipper tape 132 and a slider (not shown in figure). Accordingly, the first zipper tape 131 has a tooth side 1312 and a fixing side 1311 stitched to the first narrow fabric piece 123 underneath the left panel 121. The second zipper tape 132 has a tooth side 1322 and a fixing side 1321 stitched to the second narrow fabric piece 124 underneath the right panel 122. The slider is disposed between the first and the second zipper tapes 131, 132 to engage the tooth sides 1312, 1322 of the first and the second zipper tapes 131, 132. A first transparent reinforcing member 125 straddles over the edge of the left panel 121 and the first narrow fabric piece 123, while a second transparent reinforcing member 126 straddles over the edge of the right panel 122 and the second narrow fabric piece 124.

To attach the first and the second narrow fabric piece 123, 124 to the upper fabric 110, a first thermally meltable compound 141 is inserted between the left panel 121 and the first narrow fabric piece 123 for attaching the first narrow fabric piece 123 to the left panel 121, and a second thermally meltable compound 142 is inserted between the right panel 122 and the second narrow fabric piece 124 for attaching the second narrow fabric piece 124 to the right panel 122. Each of the thermally meltable compound 141, 142 may be a thermally meltable polyurethane resin in form of a glue film which would melt upon being heated by a thermal welding machine to result in adhesion effects.

The first and second transparent reinforcing members 125, 126 may be made of polyurethane (PU) or PVC. Accordingly, each of the first and the second transparent reinforcing members 125, 126 has a width of approximately 1 cm which binds the edge of each of the left and right panels 121, 122 by approximately 0.50 cm and the respective first and second narrow fabric pieces 123, 124 by approximately another 0.50 cm, such that each of the first and the second transparent reinforcing members 125, 126 offers the respective edge extra strength against abrasion as well as does not interrupt the pattern of the printed fabric.

Additionally, the improved laminated concealed zipper closure 100 in accordance with the present invention can further comprise a first thin nylon glue coated fabric layer 151 disposed between the left panel 121 and the first narrow fabric piece 123 and straddling over the first thermally meltable compound 141, and a second thin nylon glue coated fabric layer 152 disposed between the right panel 122 and the second narrow fabric piece 124 and straddling over the second thermally meltable compound 142 to offer extra strength. An inner flap 160, usually made of PU shell backing brush material with a width of about 3 cm, can further be stitched underneath the first zipper tape 131. Also a first thermal tape 161 of about 1.7 cm wide may be attached underneath spanning across the left panel 121 and the inner flap 160 and a second thermal tape 162 of about 1.7 cm wide may be attached underneath spanning across the second zipper tape 132 and the right panel 122 to clean finishing the zipper 130 and the inner flap 160.

Figure 3A:
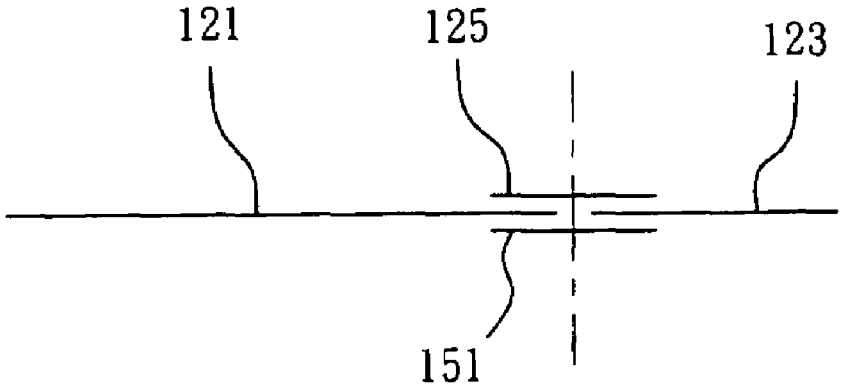
FIG. 3A is a cross-sectional view showing steps of making a laminated concealed zipper closure.

FIG. 3A illustrates initial steps of making such laminated concealed zipper closure in accordance with the present invention for the left panel 121, while the steps for the right panel are indentical which can be easily duplicated. After an upper fabric 110 is formed with a slit 120, preferably by a laser machine, the upper fabric is divided into a left panel 121 and a right panel (not shown in figure) each having an edge facing the other. A first narrow fabric piece 123 of about 1.5 cm wide is placed adjacent to the edge of the left panel 121 with a small gap in between. Then a first transparent reinforcing member 125 of about 1 cm wide is placed above the edge of the left panel 121 for about 0.5 cm and the first narrow fabric piece 123 for about another 0.5 cm such that the first transparent reinforcing member 125 spans across the edge of the left panel 121 and the first narrow fabric piece 123.

Figure 3B:
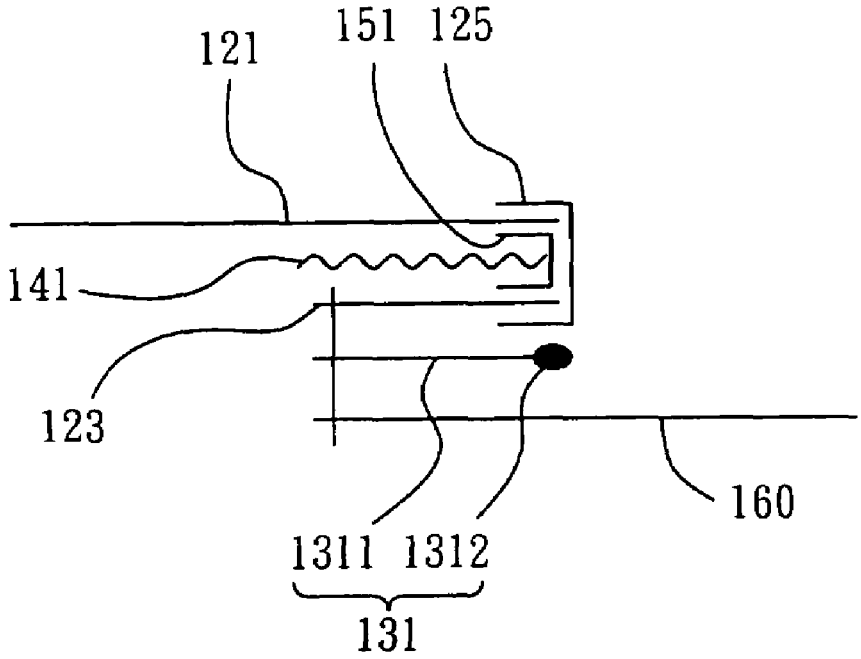
FIG. 3B is a cross-sectional view showing steps of making a laminated concealed zipper closure.

Referring to FIG. 3B, the first transparent reinforcing member 125 is now bent downwards such that the first transparent reinforcing member 125 straddles over the edge of the left panel 121 and the first narrow fabric piece 123 along the length of the slit and is substantially parallel to the slit (not shown in figure), and the first narrow fabric piece 123 is now located underneath the upper fabric 110. A first thermally meltable compound 141 is then placed between the left panel 121 and the first narrow fabric piece 123 along the length of the slit. A first zipper tape 131 is stitched underneath the first narrow fabric piece 123 and the upper fabric is now heat-pressed to form a laminated concealed zipper closure 100, as shown in FIG. 3C.

Additionally, as shown in FIG. 3A, a first thin nylon glue coated fabric layer 151 of about 1 cm wide may be further placed underneath spanning across the left panel 121 and the first narrow fabric piece 123 such that when the first transparent reinforcing member 125 is bent, the first thin nylon glue coated fabric layer 151 is bent and folded between the left panel 121 and the first narrow fabric piece 123, which in turn, the thermally meltable compound 141 can now be inserted into the folded first thin nylon glue coated fabric layer 151 instead (referring to FIG. 3B). An inner flap 160 of about 3 cm wide may be further stitched underneath the first zipper tape 131 before placing the thermally meltable compound 141 underneath the left right panel 121 or before inserting the thermally meltable compound 141 into the folded first thin nylon glue coated fabric layer 151 to offer extra strength. A first thermal tape 161 of about 1.7 cm wide is then attached underneath spanning across the left panel 121 and the inner flap 160 while a second thermal tape 162 of about 1.7 cm wide is attached underneath spanning across the second zipper tape 132 (referring to FIG. 3C) to clean finishing the zipper 130 and the inner flap 160 to offer waterproof function.

From the above, it can be seen that the present invention provides a front panel consisting of only one piece of fabric and so the whole pattern of the printing can be consistent from one side to the other side. Incorporated in conjunction with the contemporarily filed application, entitled "Improved Laminated Pocket Zipper with Zipper-Lip, Method of Making Same and Storage Cab Thereof pending Zip-Lip pocket," the garment 50 can now be presented by a non-interrupted clean, all sew-free body front with no stitching interruption and two side pockets, and a complete pattern of a printing/picture/drawing or whatever artwork can be put right on the front panel.

The structure of the present invention is not limited to the above embodiments. Although the invention has been described with reference to the preferred embodiments, it will be obvious to persons skilled in the art that various changes and modifications may be made without departing from the scope of the invention as recited in the claims.

What is claimed is:

1. A method of making a laminated concealed zipper closure for an outwear, comprising the steps of:

a. providing an upper fabric;

b. cutting a slit through the upper fabric and dividing the upper fabric into a left panel and a right panel each having an edge facing the other;

c. placing two narrow fabrics pieces adjacent to each of the edges with a small gap between the respective edge;

d. placing a transparent reinforcing member above each of the edges and the respective narrow fabrics pieces;

e. bending the transparent reinforcing member such that the transparent reinforcing member straddles over the edge of each of the left and right panels along the length thereof and substantially parallel to the slit, and over each of the narrow fabric pieces underneath the upper fabric;

f. placing a thermally meltable compound between each of the left and right panels and the respective narrow fabric piece along the length of the slit;

g. stitching a first zipper tape underneath one of the two narrow fabric pieces;

h. stitching a second zipper tape underneath the other of the two narrow fabric pieces; and i. heat-pressing the upper fabric, the two narrow fabric piece and the first and the second zipper tapes.

2. The method of claim 1, further comprising a step of placing a thin nylon glue coated fabric layer underneath each of the left and the right panels and the respective narrow fabric pieces such that when each of the transparent reinforcing members is bent, each of the thin nylon glue coated fabric layers is bent and folded between the left or the right panel and the respective narrow fabric piece and the thermally meltable compound can be inserted into each of the folded thin nylon glue coated fabric layers.

3. The method of claim 1, further comprising a step of stitching an inner flap underneath the first zipper tape before placing the thermally meltable compound underneath each of the left and right panels.

4. The method of claim 3, further comprising a step of attaching a thermal tape underneath the left panel and the inner flap and the other thermal tape underneath the second zipper tape and the right panel after heat-pressing the upper fabric, the two narrow fabric piece and the first and the second zipper tapes.

5. The method of claim 1, wherein the slit is cut by a laser machine.

* * * * *